US008690242B1

(12) United States Patent
Kobrin

(10) Patent No.: US 8,690,242 B1
(45) Date of Patent: Apr. 8, 2014

(54) BACK SUPPORT

(76) Inventor: Ilyne Kobrin, Tampa, FL (US)

( * ) Notice: Subject to any disclaimer, the term of this patent is extended or adjusted under 35 U.S.C. 154(b) by 153 days.

(21) Appl. No.: 13/372,329

(22) Filed: Feb. 13, 2012

(51) Int. Cl.
*A47C 7/02* (2006.01)
*A47C 7/46* (2006.01)

(52) U.S. Cl.
USPC ..... 297/230.13; 297/230.14; 297/284.1; 297/284.4

(58) Field of Classification Search
USPC ..... 297/440.22, 284.5, 652, 657, 230.13, 297/230.14; 5/652, 657
See application file for complete search history.

(56) References Cited

U.S. PATENT DOCUMENTS

| | | | | |
|---|---|---|---|---|
| 1,667,626 | A | 4/1928 | Epstein | |
| 2,591,306 | A | 4/1952 | Sherman | |
| 4,431,232 | A | 2/1984 | Hannouche | |
| 4,516,568 | A | 5/1985 | Baxter | |
| 4,597,386 | A * | 7/1986 | Goldstein | 602/19 |
| 5,201,761 | A | 4/1993 | Serola | |
| 5,456,519 | A | 10/1995 | Davis | |
| 5,624,158 | A * | 4/1997 | Adat et al. | 297/230.14 |
| 5,833,319 | A | 11/1998 | Davis | |
| 6,125,851 | A | 10/2000 | Walker | |
| 6,135,562 | A * | 10/2000 | Infanti | 297/440.2 |
| 6,374,440 | B1 * | 4/2002 | Thim, Jr. | 5/633 |
| 6,695,387 | B1 * | 2/2004 | Gordon | 296/153 |
| 6,971,392 | B2 | 12/2005 | Lindahn | |
| 7,757,321 | B2 * | 7/2010 | Calvert | 5/657 |
| 7,878,591 | B2 | 2/2011 | Walker | |
| 8,029,066 | B2 * | 10/2011 | Su | 297/452.18 |
| 8,087,726 | B2 * | 1/2012 | Chen | 297/284.5 |
| 2005/0151409 | A1 * | 7/2005 | Infanti et al. | 297/440.2 |

* cited by examiner

*Primary Examiner* — Sarah B McPartlin
(74) *Attorney, Agent, or Firm* — QuickPatents; Kevin Prince

(57) ABSTRACT

The present device includes a sacral support for a person sitting in a chair with a seat back. The sacral support includes a rigid base having a bottom surface, a peripheral edge, and a top surface. The top surface includes a plurality of pegs projecting upwardly away therefrom. An elastomeric cushion includes a bottom surface, a peripheral edge, and a convex top surface. The bottom surface of the cushion includes a plurality of apertures adapted to receive the pegs therein. With the cushion engaged with the base at the pegs and apertures thereof, the sacral support may be positioned against the seat back of the chair to produce pressure against the person's sacrum when seated. The sacral support includes a plurality of elastomeric cushions, each cushion having a unique height to be selected as desired by the person. Further, the device includes a mount to be used with backless chairs.

16 Claims, 4 Drawing Sheets

BACK SUPPORT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to back support device, and more particularly to sacrum support device in a seated position.

DISCUSSION OF RELATED ART

Back and spine support devices are well known in the art. Such devices are made to provide support to avoid unhealthy pressure on the spine. However, despite the development of many approaches to back support devices, these approaches often have significant drawbacks.

Many of the prior art devices teach complicated structures using pads and straps. These devices often require adjusting multiple straps to position the pads in a desired position on a chair. However, people often use several chairs at home and in the office. Attaching and reattaching a device to each chair is cumbersome and time consuming. Also, buying an extra device for every chair would be expensive and wasteful. Therefore, a spine support device is needed that is compact, easily portable, and easily used on a variety of chairs. In addition to being compact and portable, the needed device also needs to be adjustable. People come in a wide range of heights and weights. Therefore, a device is needed that is also adjustable and easily accommodates people of different sizes.

Some prior art devices are merely simple variations of a basic pillow. Though they tend to be more portable than other more cumbersome versions, they also have their drawbacks. Such pillow-type supports tend to be as wide as the back of a person and do not provide ideal support of the spine. Such prior art devices push the sacrum, pelvis and lumbar into a forward more anterior position and do not maintain an optimal sacral base angle that occurs when standing with good posture. Therefore, a device is needed that places supportive pressure only on the sacrum providing an optimal sacral base angle.

Finally, not every chair comes with a seat back. Sitting for extended periods of time without any back support can lead to back problems. Therefore, there is a need for a spinal support device that provides the option of being used on both chairs with backs and chairs without seat backs.

Therefore, there is a need for a spine support device that is compact, easily portable, and easily used on a variety of chairs with minimal effort. Such a needed device would be adjustable and easily accommodate people of different sizes. Also, a device is needed that places supportive pressure only on the sacrum providing an optimal sacral base angle. Furthermore, a spinal support device is needed that provides the option of being used on both chairs with backs and backless chairs. The present invention accomplishes these objectives.

SUMMARY OF THE INVENTION

The present device is a spinal/back and hip support device system that applies a supportive force to a person's sacrum (sacral spine) while used in a seated position. The device applies light pressure to the sacrum. The device does not directly apply pressure to lumbar spine or ilia or any other part of the back. When properly positioned adjacent to the sacrum of a person in the seated position, the device provides a light supportive force which will maintain the integrity of an optimal sacral spine angle as seen in the upright/standing position of a person using good posture. This position provides for more comfort and decreases the likelihood of developing degenerative disease of the spine and hip joints as a consequence of a poor sitting posture.

The device includes a sacral support for a person sitting in a chair having a seat back. The sacral support includes a rigid base having a bottom surface, a peripheral edge, and a top surface. The top surface includes a plurality of pegs projecting upwardly away therefrom.

An elastomeric cushion includes a bottom surface, a peripheral edge, and a convex top surface. The bottom surface of the cushion includes a plurality of apertures each aligned with one of the pegs of the base and adapted to receive the peg therein. The bottom surface of the cushion is supported by the top surface of the base and is laterally mutually constrained by the plurality of pegs engaged in the plurality of apertures. With the cushion engaged with the base at the pegs and apertures thereof, the sacral support may be positioned against the seat back of the chair to produce supportive pressure against the person's sacrum when seated.

The base may further include a peripheral wall extending upwardly from the top surface of the base. The peripheral wall further captures the elastomeric cushion to inhibit lateral relative motion thereof. A version of the elastomeric cushion is substantially hollow but for a plurality of strengthening ribs radiating laterally away from a central axis thereof. The plurality of strengthening ribs apply substantially uniformly decreasing resistance based on the radial distance from the central axis.

The base may further include a channel, whereby the base may be adjusted in one dimension along a cooperative track. The channel preferably bifurcates the base along a longitudinal centerline thereof. In another version, the sacral support includes a plurality of elastomeric cushions with each cushion having a unique height. In this version, any of the cushions may be selected based on the chair and size of the person. Higher or lower heights may be selected as desired by the person. The sacral support is then positioned to produce pressure against the person's sacrum when seated.

In another version, to be used on backless chairs, the sacral support includes a mount having a chair attachment on a bottom portion thereof and an adjustable base attachment on a top portion thereof. With the mount attached to the chair at the chair attachment, and the base attached to the mount at the base attachment, the sacral support may be adjustably positioned on the mount to produce pressure against the person's sacrum when seated in a chair with no seat back.

The present invention is a spine support device that is compact, easily portable, and easily used on a variety of chairs with minimal effort. The device is adjustable and easily accommodates people of different sizes. Also, the device places supportive pressure only on the sacrum providing an optimal sacral base angle. Moreover, the spinal support device provides the option of being used on both chairs with backs and backless chairs. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 2:
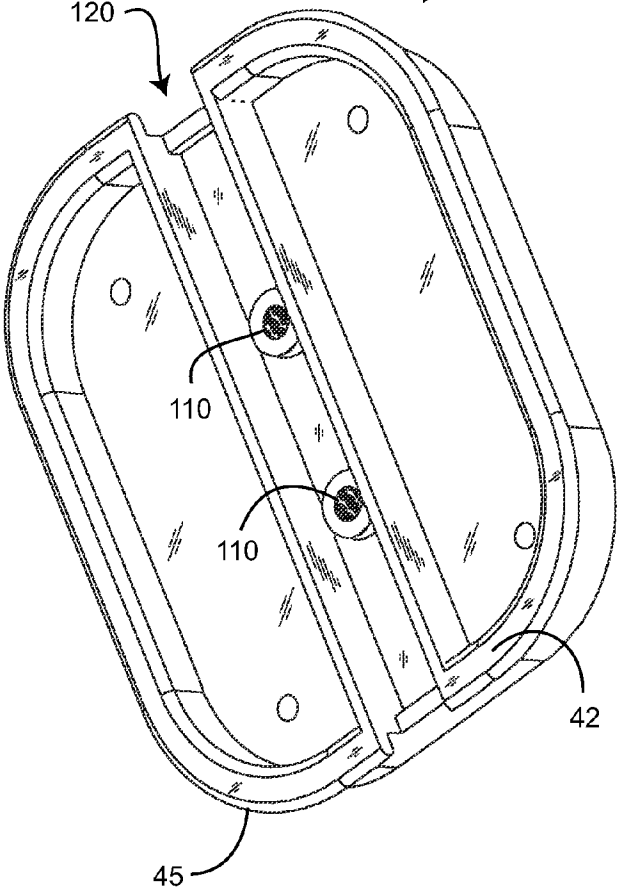
FIG. 2 is a bottom perspective view of the invention, illustrating a base with magnets.
Figure 1:
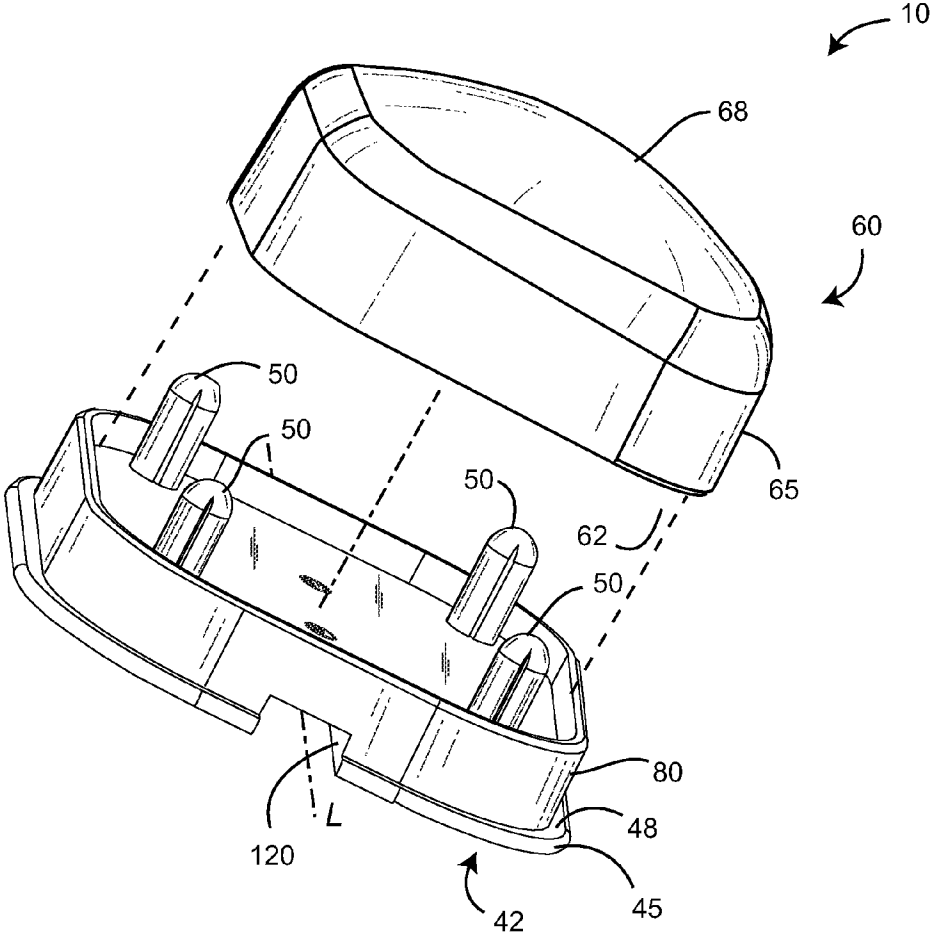
FIG. 1 is a side perspective view of the invention, illustrating a cushion and base.
Figure 5:
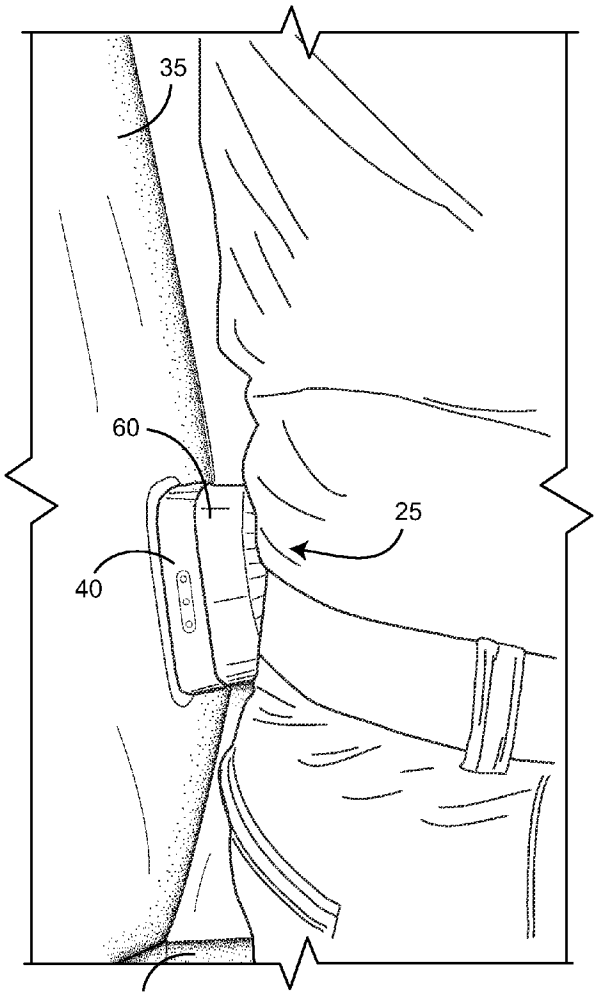
FIG. 5 is a side perspective view of the invention in use.
Figure 4:
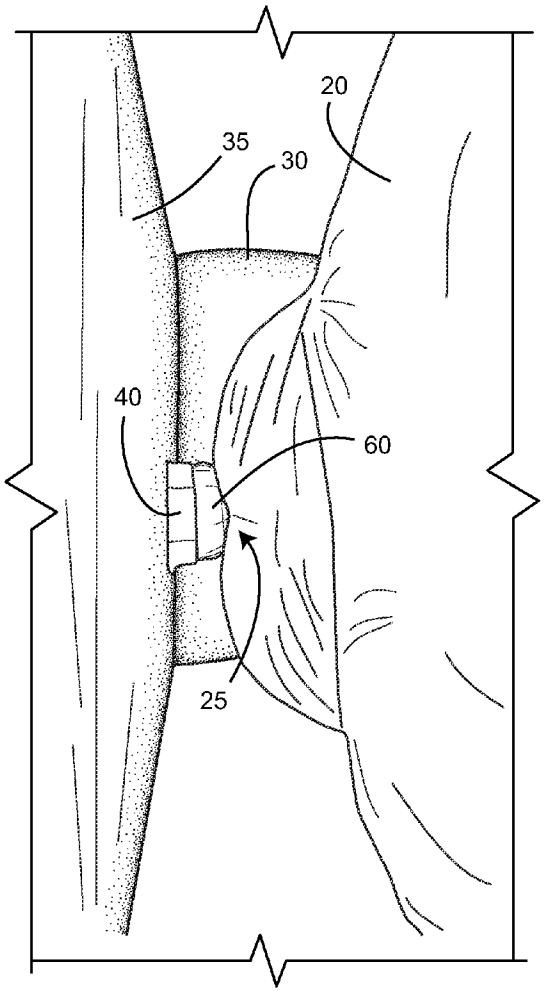
FIG. 4 is a side perspective view of the invention in use.

With respect to the drawings, FIGS. 4 and 5 illustrate a sacral support 10 for a person 20 sitting in a chair 30 having a seat back 35. In FIGS. 1 and 2, the sacral support 10 includes a rigid base 40 that includes a bottom surface 42, a peripheral edge 45, and a top surface 48. In FIG. 1, the top surface 48 includes a plurality of pegs 50 projecting upwardly away therefrom. In one embodiment, the plurality of pegs 50 is exactly four pegs 50.

Figure 3:
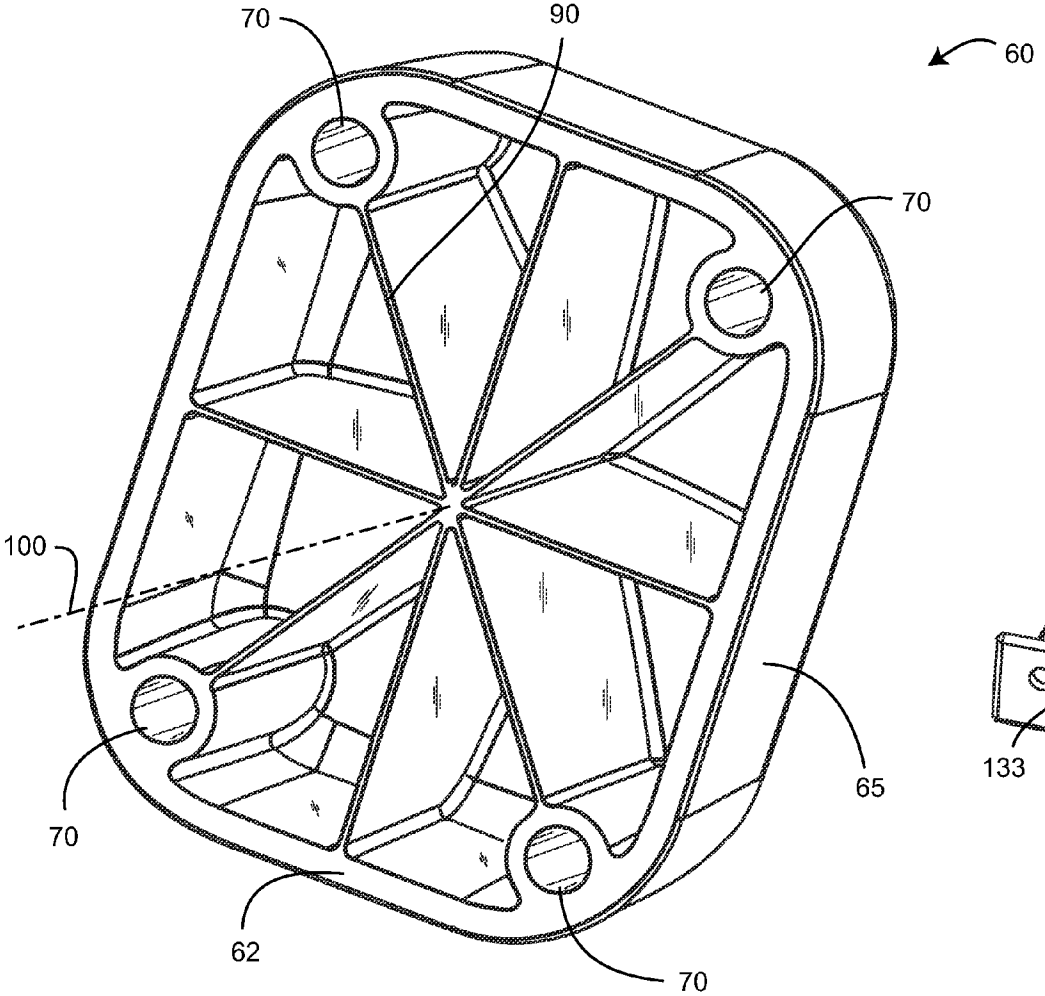
FIG. 3 is a bottom perspective view of a cushion.

In FIGS. 1 and 3, an elastomeric cushion 60 includes a bottom surface 62, a peripheral edge 65, and a convex top surface 68. The bottom surface 62 includes a plurality of apertures 70 (FIG. 3) each aligned with one of the pegs 50 of the base 40 and adapted to receive the peg 50 therein. In FIG. 1, the bottom surface 62 of the cushion 60 is supported by the top surface 48 of the base 40 and is laterally mutually constrained by the plurality of pegs 50 engaged in the plurality of apertures 70. In one embodiment, the elastomeric cushion 60 is made principally from an elastomeric, resilient rubber material, though other suitable similar materials may be used. In another embodiment, the base 40 is made from a rigid durable material such as a hard plastic, though other suitable rigid materials may be used such as hard woods or light metal materials.

With the cushion 60 engaged with the base 40 at the pegs 50 and apertures 70 thereof, the sacral support 10 may be positioned against the seat back 35 of the chair 30 to produce pressure against the person's sacrum 25 when seated providing an optimal sacral base angle, as illustrated in FIGS. 4 and 5. Using the support 10 will minimize the negative effects of sitting on the spine and hips by properly distributing weight and maintaining the natural functional spinal curves that occur when standing upright. Providing supportive pressure against the sacrum decreases the likelihood of developing degenerative disease of the spine and hip joints that results as a consequence of poor sitting posture. In an alternative embodiment, the cushion 60 is used independent of the base 40, making the sacral support 10 even more compact and easier to transport. In this embodiment, the person 20 sits back against the properly placed cushion 60 between the person's sacrum 25 and the seat back 35 of the chair 30.

In one embodiment in FIG. 1, the base 40 further includes a peripheral wall 80 extending upwardly from the top surface 48 of the base 40. The peripheral wall 80 further captures the elastomeric cushion 60 to inhibit lateral relative motion thereof.

In another embodiment in FIG. 3, the elastomeric cushion 60 is substantially hollow but for a plurality of strengthening ribs 90 radiating laterally away from a central axis 100 thereof. In one embodiment, the plurality of strengthening ribs 90 apply substantially uniform decreasing resistance based on the radial distance from the central axis 100.

Figure 7:
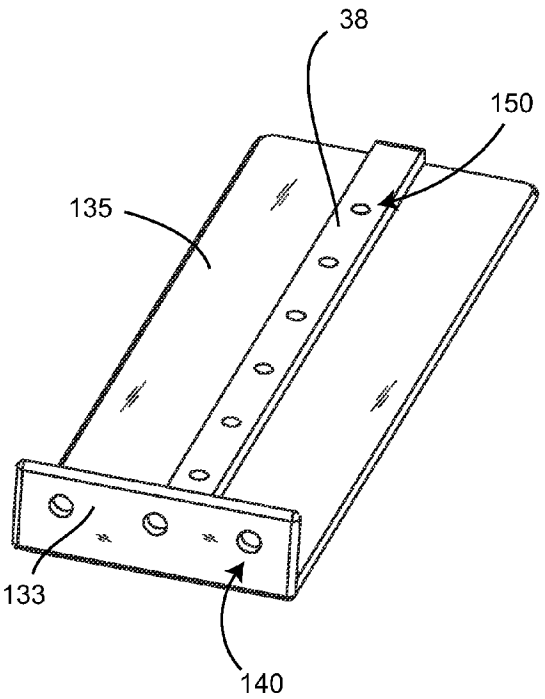
FIG. 7 is a perspective view of a mount.

In FIG. 2, the base further includes a channel 120, whereby the base may be adjusted in one dimension along a cooperative track 38 (FIG. 7). In one embodiment, the channel 120 bifurcates the base 40 along a longitudinal centerline L thereof. In one embodiment, the channel 120 further includes at least one magnet 110, whereby the base may be selectively and magnetically affixed with the cooperative track 38. The cooperative track 38 may include magnetically attracted materials such as iron strips or additional magnets (not shown). The base 40 and cushion 60 may be adjusted up or down along the track 38 to be positioned against the person's sacrum 25 when seated. After the sacral support 10 is adjusted as desired, the track 38 keeps the cushion 60 in the desired location, allowing the person to stand and sit without needing to reposition the cushion 60. In another embodiment, the support 10 may include additional adjustment accessories (not shown) to be magnetically affixed with the channel 120 to adjust the sacral support 10 against the person's sacrum 25 when seated.

Figure 6:
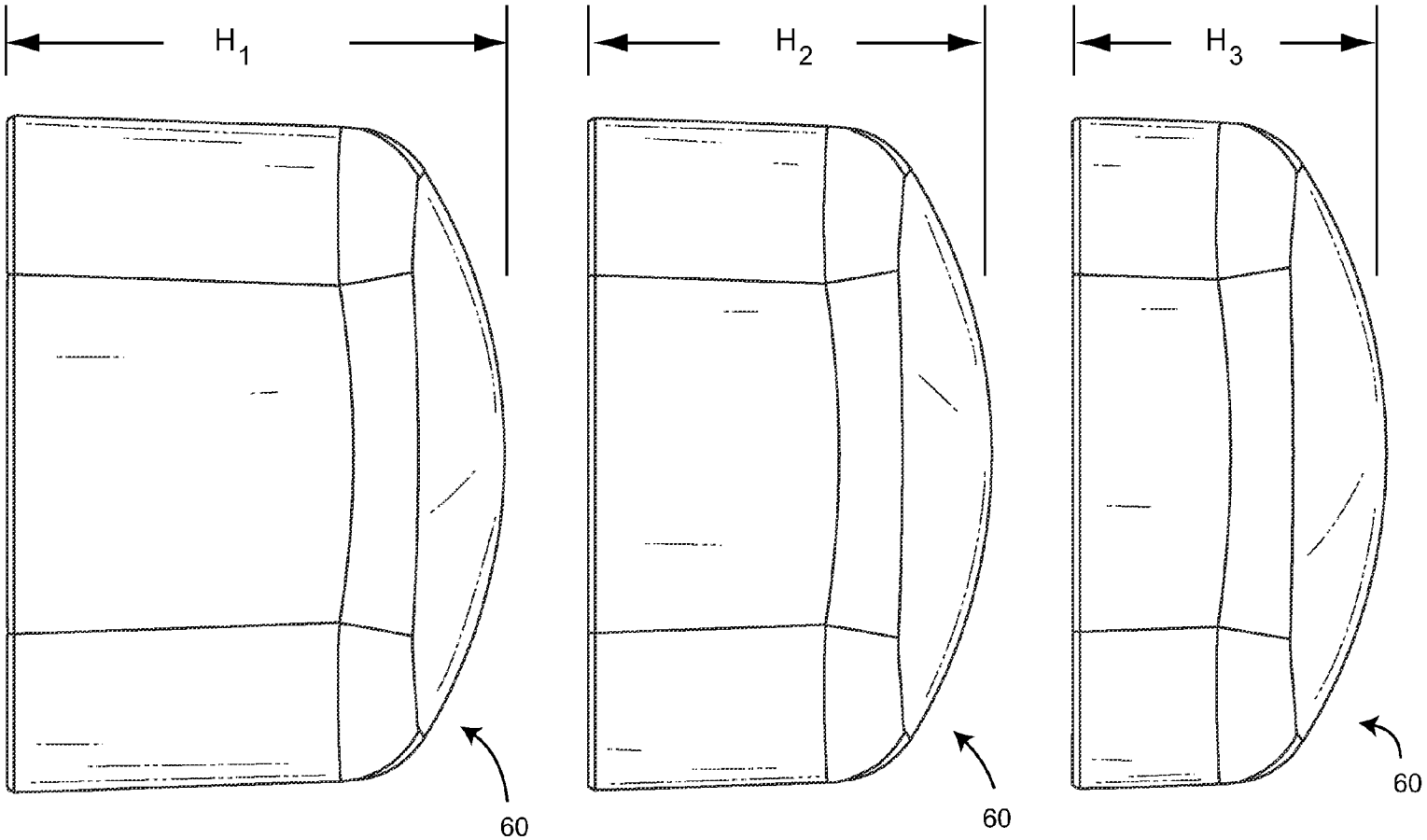
FIG. 6 is a side elevational view of three cushions, each with a different height.

In another embodiment, illustrated in FIG. 6, the sacral support 10 includes a plurality of elastomeric cushions 60 with each cushion having a unique height $H_1$, $H_2$, $H_3$. In this embodiment, any of the cushions 60 may be selected based on the chair 30 and size of the person 20. Higher or lower heights may be selected as desired by the person 20. The sacral support 10 is then positioned to produce pressure against the person's sacrum 25 when seated. In one embodiment, each cushion 60 is made with a different composition of elastomeric material, whereby the resistance of the ribs 90 of each cushion 60 is mutually unique, providing people of different sizes and weights cushions 60 with a suitable level of resistance to comfortably support the person's sacrum 25. In another embodiment, each cushion 60 is made with a different composition of elastomeric material, whereby the visual appearance of each cushion 60 is mutually unique, allowing a person 20 to easily distinguish between cushions 60 of different heights or different resistances.

In another embodiment in FIG. 7, the sacral support 10 includes a mount 130. The mount 130 includes a chair attachment 140 on a bottom portion 133 thereof and an adjustable base attachment 150 on a top portion 135 thereof. With the mount 130 attached to the chair 30 at the chair attachment 140, the base 40 attached to the mount 130 at the base attachment 150, and the cushion 60 engaged with the base 40 at the pegs 50 and apertures 70 thereof, the sacral support 10 may be adjustably positioned on the mount 130 to produce pressure against the person's sacrum 25 when seated. The mount 130 allows the sacral support 10 to be used with chairs without a seat back, though the mount 130 may also be used with some chairs having seatbacks depending on the design of the chair.

In one embodiment in FIG. 7, the mount 130 is an L-shaped bracket. The chair attachment 140 may further include screws (not shown) to attach the mount 130 to the chair 30, though other common attachment devices may be used such as nails (not shown), depending on the nature of the chair 30. In one embodiment, the adjustable base attachment 150 includes a cooperative track 38 (FIG. 7), whereby the base 40 may be selectively affixed with the track 38 to position the cushion 60 against the person's sacrum 25 when seated. In another embodiment, the channel 120 further includes at least one magnet 110, whereby the base 40 may be selectively and magnetically affixed with the track 38. In an alternative embodiment, adjustable base attachment 150 and the channel 120 include a hook and loop type fastener, whereby the base 40 may selectively attached to the mount 130.

While a particular form of the invention has been illustrated and described, it will be apparent that various modifications can be made without departing from the spirit and scope of the invention. For example, the adjustable base attachment 150 may further include a strap (not shown) that is magnetically attached to the base 40, whereby the strap wraps around a seat back 35 and secures the support 10 at a desired location. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A sacral support for a person sitting in a chair having a seat back, comprising:

a rigid base that includes a bottom surface, a peripheral edge, and a top surface, the top surface including a plurality of pegs projecting upwardly away therefrom; and an elastomeric cushion that includes a bottom surface, a peripheral edge, and a convex top surface, the bottom surface including a plurality of apertures each aligned with one of the pegs of the base and adapted to receive the peg therein, the bottom surface of the cushion being supported by the top surface of the base and laterally mutually constrained by the plurality of pegs engaged in the plurality of apertures, the elastomeric cushion being substantially hollow but for a plurality of strengthening ribs radiating laterally away from a central axis thereof;

whereby with the cushion engaged with the base at the pegs and apertures thereof, the sacral support may be positioned against the seat back of the chair to produce pressure against the person's sacrum when seated.

2. The sacral support of claim 1 wherein the base further includes a peripheral wall extending upwardly from the top surface of the base, the peripheral wall further capturing the elastomeric cushion to inhibit lateral relative motion thereof.

3. The sacral support of claim 1 wherein the plurality of pegs is exactly four pegs.

4. The sacral support of claim 1 wherein the plurality of strengthening ribs apply substantially uniform decreasing resistance based on the radial distance from the central axis.

5. The sacral support of claim 1 wherein the elastomeric cushion is made principally from an elastomeric, resilient rubber material.

6. The sacral support of claim 1 wherein the base further includes a channel, whereby the base may be adjusted in one dimension along a cooperative track.

7. The sacral support of claim 6 wherein the channel bifurcates the base along a longitudinal centerline thereof.

8. The sacral support of claim 6 wherein the channel further includes at least one magnet, whereby the base may be selectively and magnetically affixed with the cooperative track.

9. A sacral support for a person sitting in a chair having a seat back, comprising:

a rigid base that includes a bottom surface, a peripheral edge, and a top surface, the top surface including a plurality of pegs projecting upwardly away therefrom; and a plurality of elastomeric cushions that each include a bottom surface, a peripheral edge, and a convex top surface, the bottom surface including a plurality of apertures each aligned with one of the pegs of the base and adapted to receive the peg therein, the bottom surface of each cushion being supportable by the top surface of the base and laterally mutually constrained by the plurality of pegs engaged in the plurality of apertures, each cushion having a unique height, each elastomeric cushion being substantially hollow but for a plurality of strengthening ribs radiating laterally away from a central axis thereof;

whereby any of the cushions may be selected based on the chair and size of the person and engaged with the base at the pegs and apertures thereof, the sacral support being positioned against the seat back of the chair to produce pressure against the person's sacrum when seated.

10. The sacral support of claim 9 wherein the base further includes a peripheral wall extending upwardly from the top surface of the base, the peripheral wall further capturing one of the elastomeric cushions to inhibit lateral relative motion thereof.

11. The sacral support of claim 9 wherein the plurality of pegs is exactly four pegs.

12. The sacral support of claim 9 wherein the plurality of strengthening ribs of each elastomeric cushion apply substantially uniform decreasing resistance based on the radial distance from the central axis.

13. The sacral support of claim 12 wherein each elastomeric cushion is made principally from an elastomeric, resilient rubber material.

14. The sacral support of claim 12 where each cushion is made with a different composition of elastomeric material, whereby the resistance of the ribs of each cushion is mutually unique.

15. The sacral support of claim 12 where each cushion is made with a different composition of elastomeric material, whereby the visual appearance of each cushion is mutually unique.

16. A sacral support for a person sitting in a chair, comprising:

a rigid base that includes a bottom surface, a peripheral edge, and a top surface, the top surface including a plurality of pegs projecting upwardly away therefrom, and a channel including at least one magnet;

a mount that includes a chair attachment on a bottom portion and an adjustable base attachment on a top portion, the adjustable base attachment including a cooperative track, whereby the base may be selectively affixed with the track; and an elastomeric cushion that includes a bottom surface, a peripheral edge, and a convex top surface, the bottom surface including a plurality of apertures each aligned with one of the pegs of the base and adapted to receive the peg therein, the bottom surface of the cushion being supported by the top surface of the base and laterally mutually constrained by the plurality of pegs engaged in the plurality of apertures;

whereby with the mount attached to the chair at the chair attachment, the base attached to the mount at the base attachment, and the cushion engaged with the base at the pegs and apertures thereof, the sacral support may be adjustably positioned on the mount to produce pressure against the person's sacrum when seated, and whereby the base may be selectively and magnetically affixed with the track.

* * * * *